US007976193B2

(12) United States Patent
Klein et al.

(10) Patent No.: US 7,976,193 B2
(45) Date of Patent: Jul. 12, 2011

(54) PLIABLE COMBINED SUPPORTS FOR DECORATIVE LIGHTING

(75) Inventors: Dean A Klein, Palm Bay, FL (US); Rene Marie Smith, Satellite Beach, FL (US)

(73) Assignee: R&D Prototyping LLC, Satellite Beach, FL (US)

( * ) Notice: Subject to any disclaimer, the term of this patent is extended or adjusted under 35 U.S.C. 154(b) by 154 days.

(21) Appl. No.: 12/399,937

(22) Filed: Mar. 7, 2009

(65) Prior Publication Data

US 2010/0226141 A1 Sep. 9, 2010

(51) Int. Cl.
*F21S 4/00* (2006.01)

(52) U.S. Cl. ..... 362/249.16; 249/11

(58) Field of Classification Search ..... 362/121, 362/122, 145, 152, 234, 249.01, 249.11, 362/249.16, 391, 396, 407, 430, 432, 457, 362/458, 806; 248/215, 227.4, 229.26, 301, 248/304, 310, 316.7

See application file for complete search history.

(56) References Cited

U.S. PATENT DOCUMENTS

| | | | | |
|---|---|---|---|---|
| 4,905,131 | A * | 2/1990 | Gary | 362/249.01 |
| 6,109,765 | A * | 8/2000 | Blanton | 362/249.16 |
| 7,111,360 | B1 * | 9/2006 | Hsu | 16/85 |
| 7,306,354 | B2 * | 12/2007 | Haas | 362/432 |

* cited by examiner

*Primary Examiner* — Hargobind S Sawhney

(57) ABSTRACT

A pliable combined support for decorative lighting comprises a receiver light mount having a light retaining notch and an insert light mount having a light retaining notch. The receiver light mounting bracket assembly is provided with an elongated channel with a tangential extrusion with holes for mounting to a surface or structure and gripping points for receiving lights. The insert light mounting bracket has an elongated insert with a tangential extrusion with holes for mounting to a surface or structure and gripping points for receiving lights. The receiver and insert mounting brackets may be coupled for a rotational frictional attachment whereby the lighting may be displayed in a fixed position along a building, structure, or surface. The receiver and insert mounting brackets can also provide a storage method that will allow lights to be stacked or boxed without tangling. The receiver and insert brackets are interchangeable so that either can be attached to a building or used for decorative light support and storage.

1 Claim, 12 Drawing Sheets

PLIABLE COMBINED SUPPORTS FOR DECORATIVE LIGHTING

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field

This invention relates generally to Pliable Combined Supports, and more particularly to such supports which are used for attaching decorative lights to buildings or structures and which can store lights without forming tangles or damaging the bulbs.

2. Prior Art

Decorative lighting is commonly displayed seasonally on buildings and structures. Such lighting is also removed from display at the end of the season and then redisplayed when the season begins again.

Previously, this lighting was stored by the consumer by wrapping, bundling, or boxing. However, consumers objected since these methods frequently lead to tangling, thereby damaging wires and bulbs and rendering them inoperable.

Thereafter, inventors created several types of articles to store decorative lights in such a way as to leave them undamaged after they were removed from display at the end of the season. U.S. Pat. No. 6,557,792 B1 to Mark Snow (2003) discloses a simple reel which can roll lighting on a spool minimizing tangling upon storage; however, these reels are difficult to wind and unwind because the light sockets tangle in the wire layers above. They also do not provide protection to the inner bulbs which are vulnerable to damage from outer layers of lighting wrapping over them.

Thus, if the decorative lighting is wound too tight then damage may occur, rendering the lighting useless. Also the reels are relatively expensive to manufacture; and one reel only stores an average-length strand of decorative lighting. Finally, the reels also do not accommodate the newer styles of decorative lighting which are much wider than the reel, itself.

A single-bulb holder has been introduced in U.S. Pat. No. 5,249,108 to Lonnie F. Gary (1992) which attaches to individual bulbs in the decorative lighting and then clips to a building or structure. These single-bulb holders are inexpensive to manufacture; however, many are needed for each piece of decorative lighting and they do not provide shear, tensile, compression, or tension support to the decorative lighting strands. These single-bulb holders are also not effective in preventing tangling-damage or pulling-damage to the decorative lighting during storage.

The decorative lighting must hang without support or lay in a pile while the single-bulb holders are attached to (or unattached from) the house. Thus, if the decorative lighting has been attached to a single-bulb holder and then clipped to a building or structure, the single-bulb holder may increase the possibility of damage to the decorative lighting. Further, the single-bulb holders are removed and stored seasonally, again increasing the possibility of damage to the decorative lighting by frequent handling.

3. Advantages

Accordingly, besides the objects and advantages of providing shear, tensile, compression, and tension support to decorative lighting described in our above patent, several objects and advantages of the present invention are:

(a) to provide a support which allows easy attachment of decorative lighting to a structure or building;
(b) to provide a support which will allow attachment of a wide variety of styles of decorative lighting;
(c) to provide reversible coupling supports that allow the decorative lighting to be attached to the receiving mount (Receiver) or the insert mount (Insert) at the consumer's discretion;
(d) to provide a coupling support with a standardized receiving mount (Receiver) that will allow switching of decorative lighting for different seasons and occasions without requiring the detachment of the receiving mount (Receiver) from structure of the building;
(e) to provide a coupling support with a standardized insert mount (Insert) that will allow switching of decorative lighting for different seasons and occasions without requiring the detachment of the insert mount (Insert) from the structure of the building;
(f) can be produced in a relatively inexpensive extrusion and stamping process;
(g) allows a variety of colors;
(h) to provide a storage method that will allow lights to be stacked or boxed without tangling;
(i) to provide a versatile support that can accommodate sloped, vertical, or horizontal structures; and,
(j) can be produced in variable lengths and cut by the consumer to exactly fit the structure.

SUMMARY

In accordance with the present invention a pliable combined support for decorative lighting comprises a receiver light mount having a light retaining notch and an insert light mount having a light retaining notch. One embodiment has a receiver mount attached to a structure and decorative lighting is attached to an insert mount. Then the insert mount is attached to the receiver mount. The decorative lighting can remain on the insert mount for storage when the receiver mount and insert mount are decoupled.

DRAWINGS—FIGURES

DRAWINGS—REFERENCE NUMERALS

| | | | |
|---|---|---|---|
| 110 | receiver mount base | 112 | lead-in notch |
| 114 | hole with grip | 116 | gripping points |
| 118 | hole | 120 | receiver mount grip |
| 122 | gap | | |
| 210 | insert mount base | 212 | lead-in notch |
| 214 | hole with grip | 216 | gripping points |
| 218 | hole | 220 | insert mount insert |

DETAILED DESCRIPTION—FIRST EMBODIMENT—FIGS. 1, 2, 3, 5, AND 7

Figure 2:
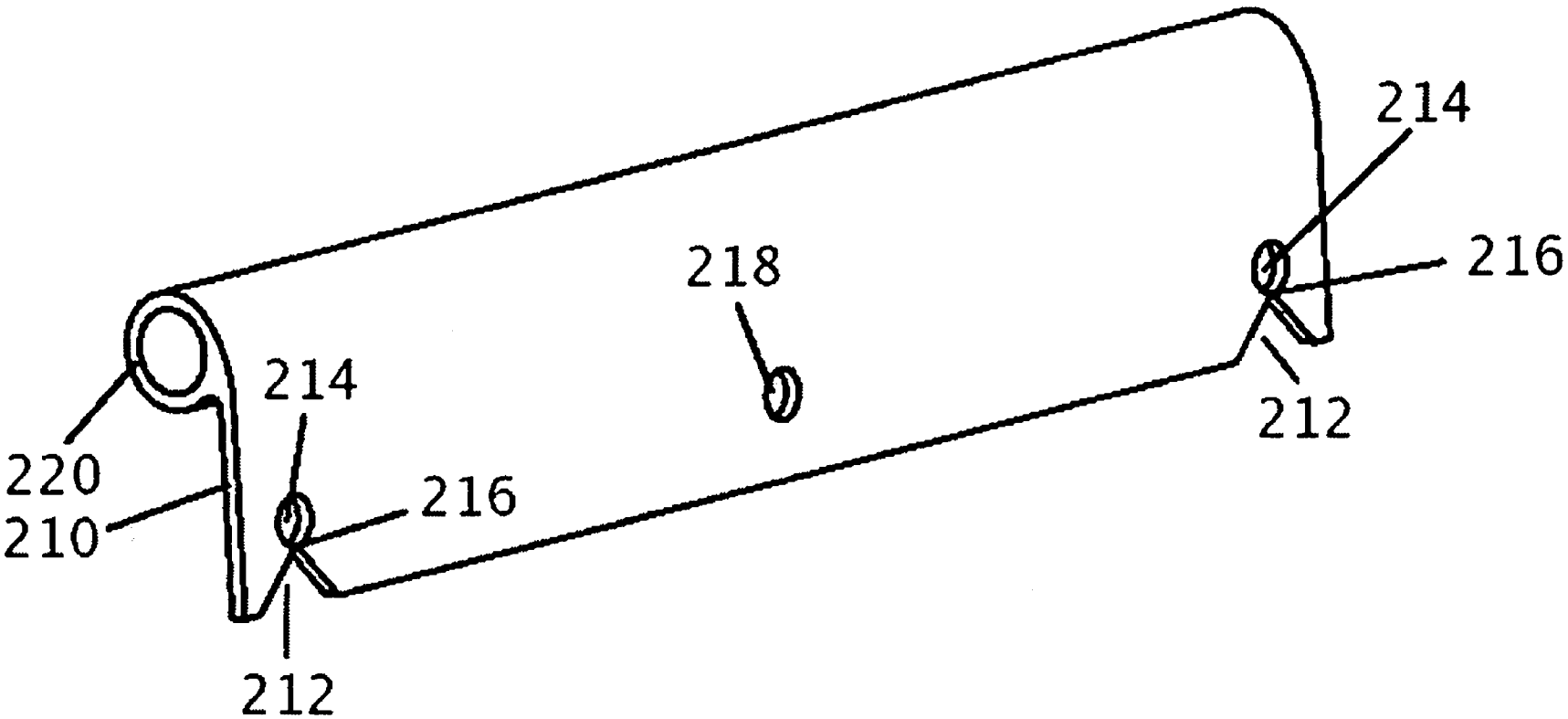
FIG. 2 is the isometric view of the insert mount.
Figure 3:
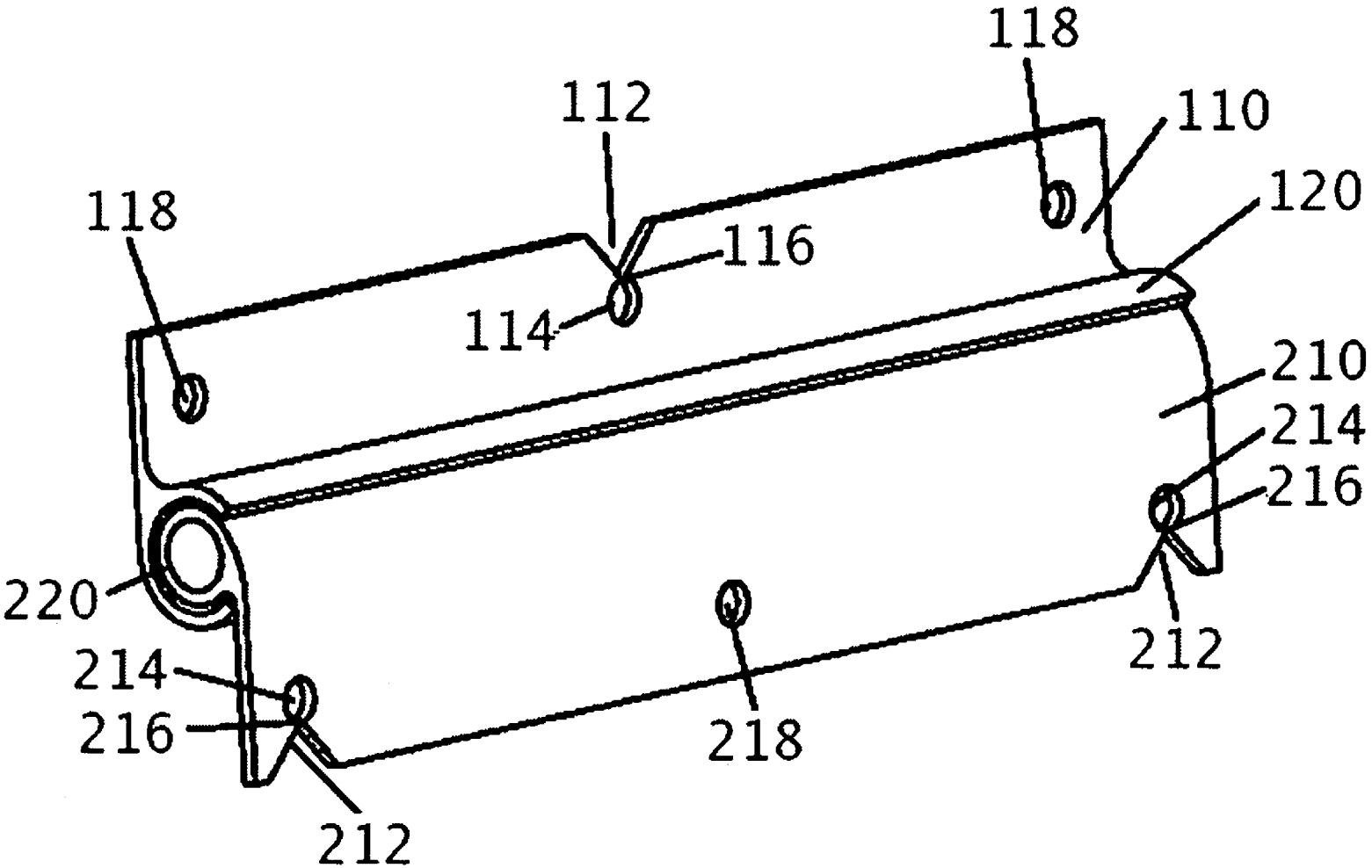
FIG. 3 is the isometric view of the pliable combined support (assembled Receiver and insert mounts).
Figure 4:
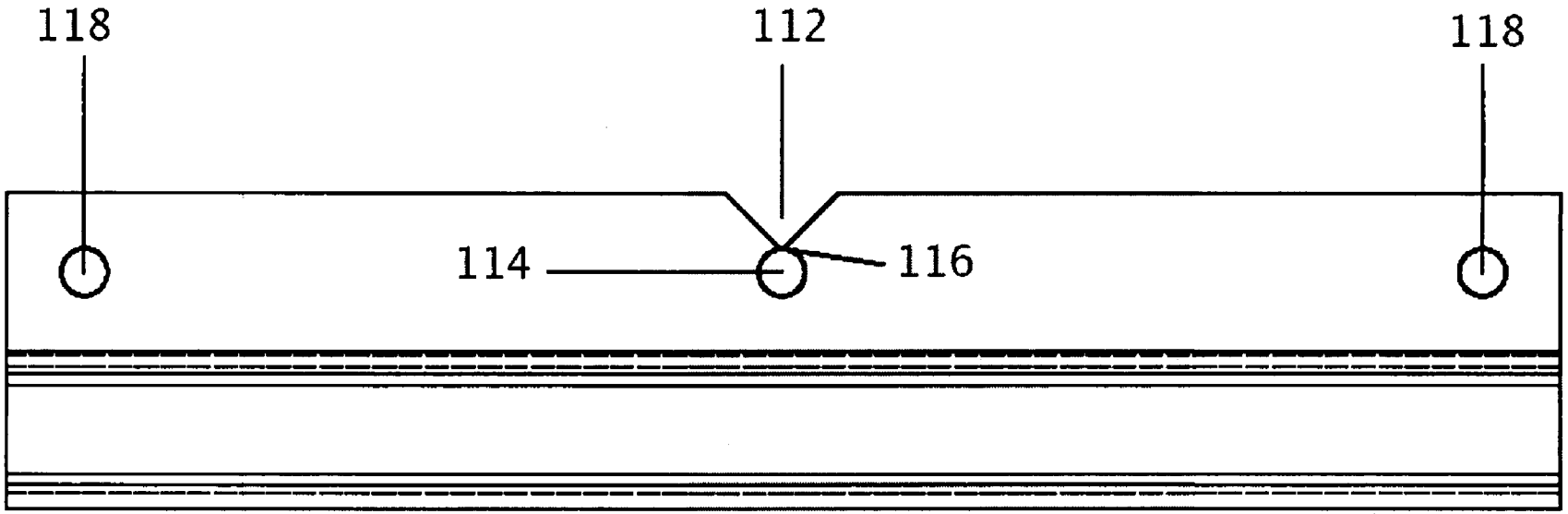
FIG. 4 is the front view of the receiver mount.

FIG. 3 shows one embodiment of a combined support. The combined support has a receiver mount base FIG. 1 of uniform cross section consisting of flexible material which can be repeatedly flexed without fracturing. The combined supports (receiver and insert mounts—FIGS. 1 and 2) are a flexible plastic that can be exposed to prolonged sunlight and outdoor weather conditions with minimal degradation. However, the combined supports can consist of any material that can be repeatedly bent without fracturing, such as polyethylene, polypropylene, vinyl, nylon, rubber, various impregnated or laminated fibrous materials, various plasticized materials, etc.

Figure 1:
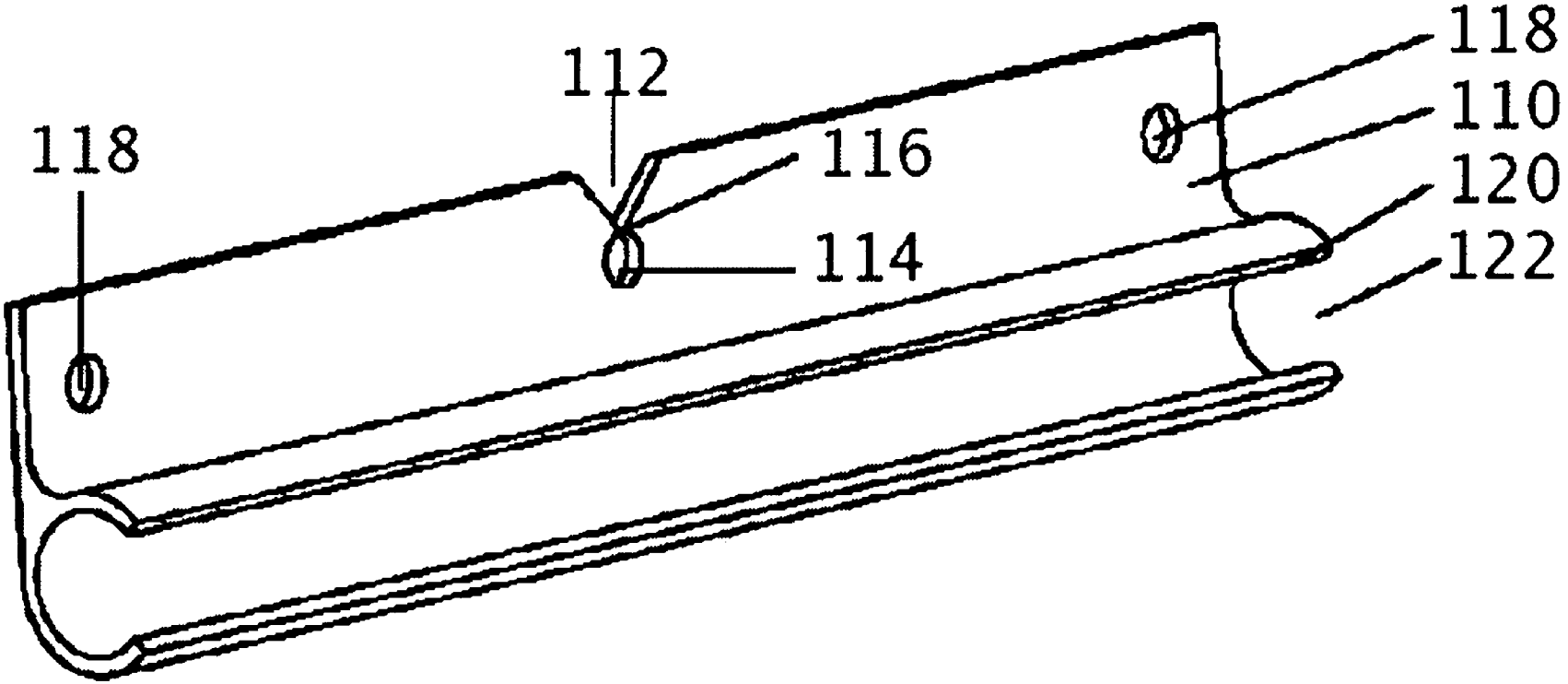
FIG. 1 is the isometric view of the receiver mount.

FIG. 1 is a receiver mount. On one half of the receiver mount is the receiver base 110. Receiver base 110 has lead in notch 112 which terminates in gripping points 116 and leads to a hole with gripping point 114. Receiver base 110 can consist of many notches 112 with gripping points 116 and holes with gripping points 114 along its length. We presently contemplate that the receiver mount base 110 has attachment holes 118 at various points along its length to facilitate attaching the device to a structure. However, it can have notched holes (112, 116, and 114), attachment holes 118, or a combination of both of these. On the other half of the receiver mount in FIG. 1 is the receiver mount grip 120. Receiver mount grip 120 has a cross section shown in FIG. 5.

FIG. 2 is an insert mount. On one half of the insert mount in FIG. 2 is an insert base 210. Insert base 210 has lead in notch 212 which terminates in gripping points 216 and leads to a hole with gripping point 214. Insert base 210 can consist of many notches 212 with gripping points 216 and holes with gripping points 214 along its length. We presently contemplate that the insert mount base 210 has attachment holes 218 at various points along its length to facilitate attaching the device to a structure. However, it can have notched holes (212, 216, and 214), attachment holes 218, or a combination of both of these. On the other half of insert mount in FIG. 2 is the insert mount insert 220. Insert mount insert 220 has a cross section shown in FIG. 7.

Figure 5:
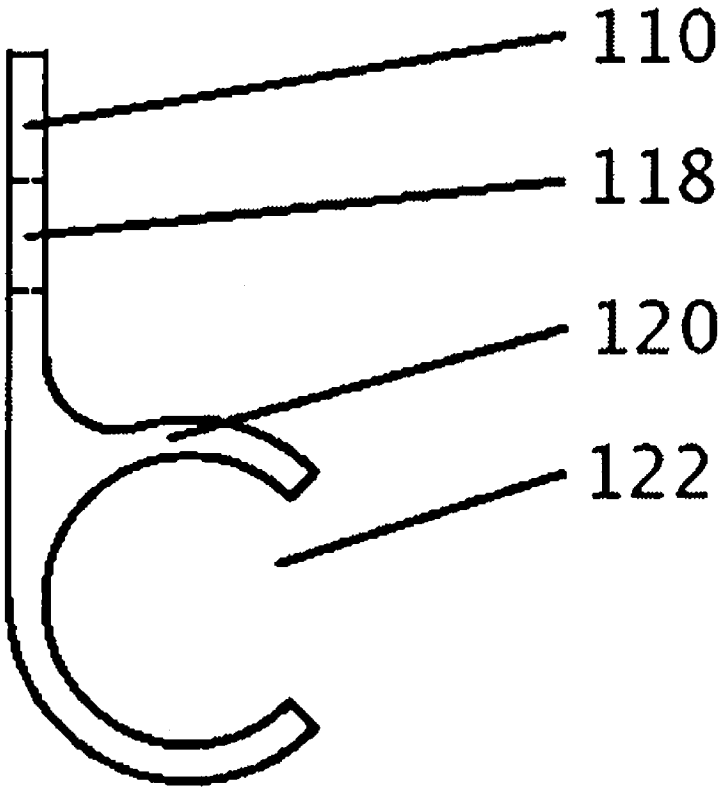
FIG. 5 is the sectional view of the receiver mount.
Figure 6:
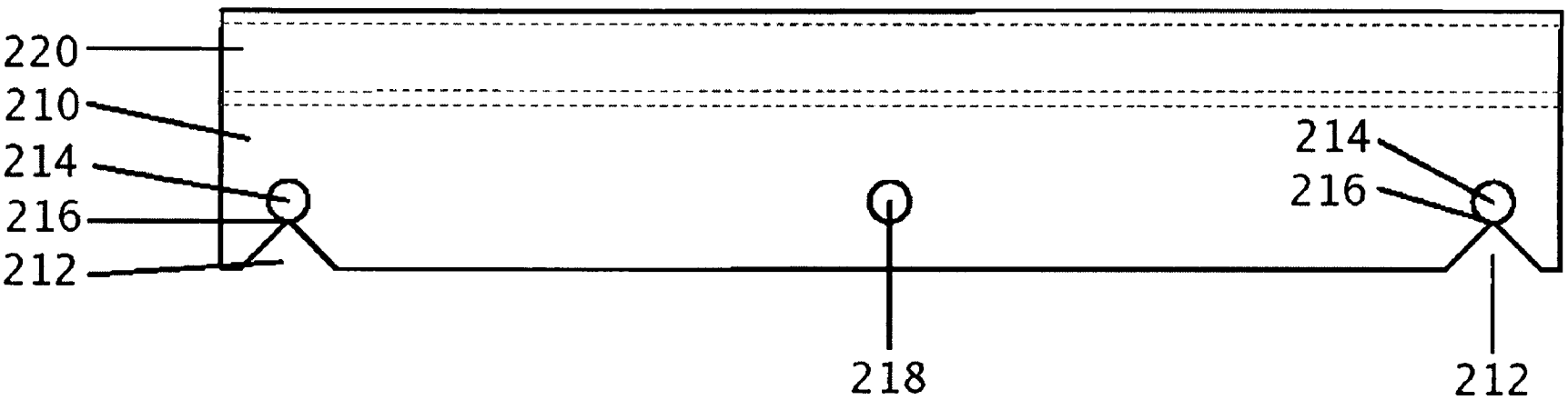
FIG. 6 is the back view of the insert mount.
Figure 7:
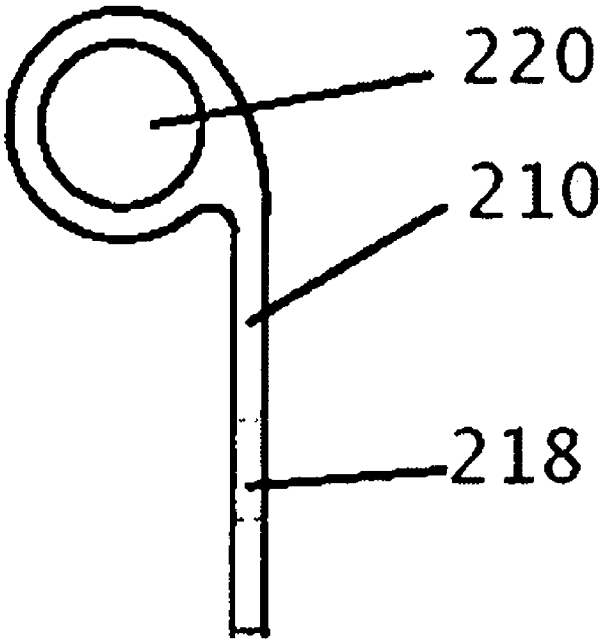
FIG. 7 is the sectional view of the insert mount.

The combined support is comprised of a receiver mount FIG. 1 (isometric view) and an insert mount FIG. 2 (isometric view). We presently contemplate that the receiver mount grip 120 in FIG. 1 and insert mount insert 220 in FIG. 2 would have a circular cross section (FIG. 5 and FIG. 7). However, it can have different cross sections, such as oval, triangular, circular, etc., and different sizes.

OPERATION—FIRST EMBODIMENT—FIGS. 1, 2, 3, 7, 8, AND 12

Figure 8:
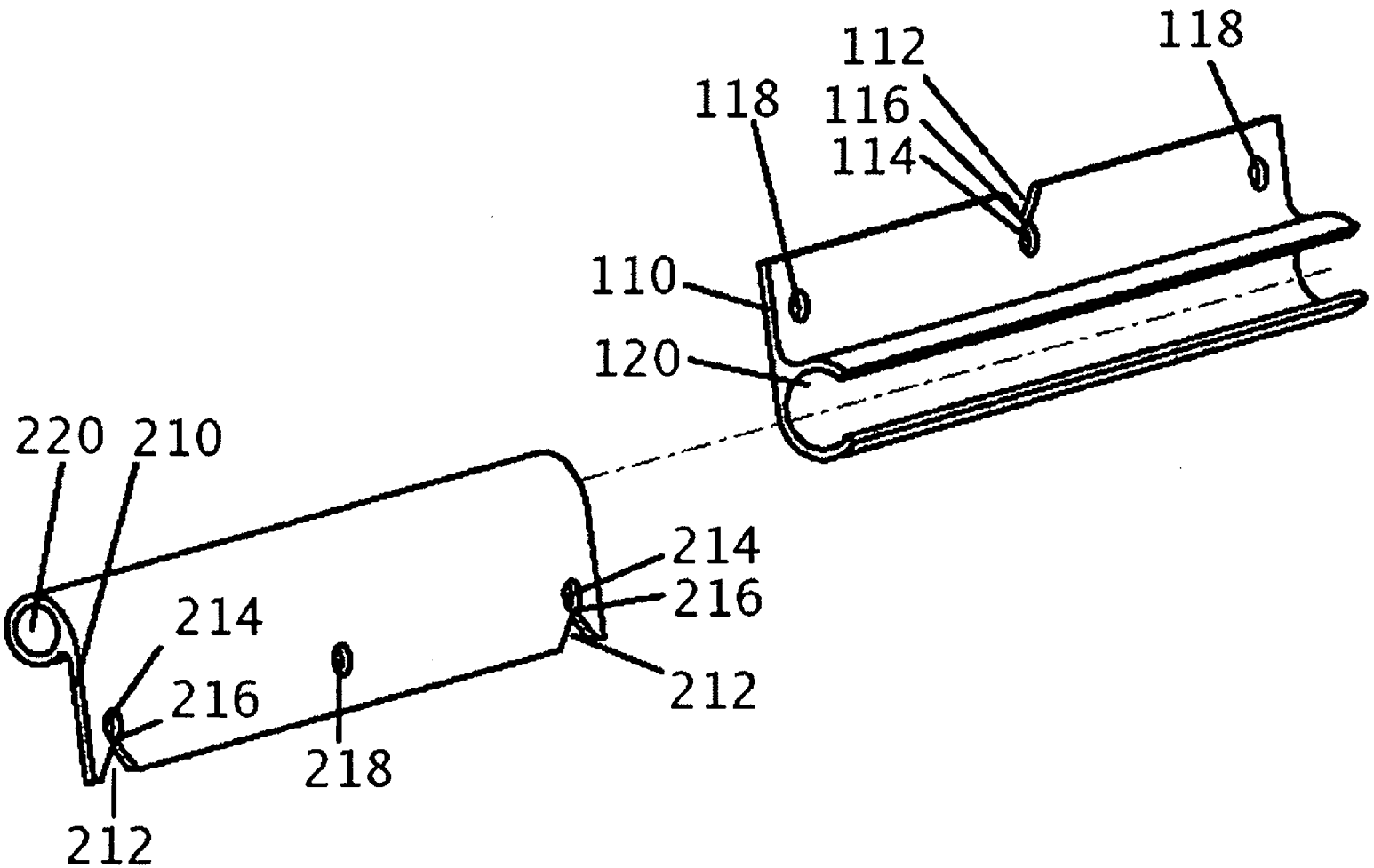
FIG. 8 is the exploded view of the receiver and insert mount.
Figure 12:
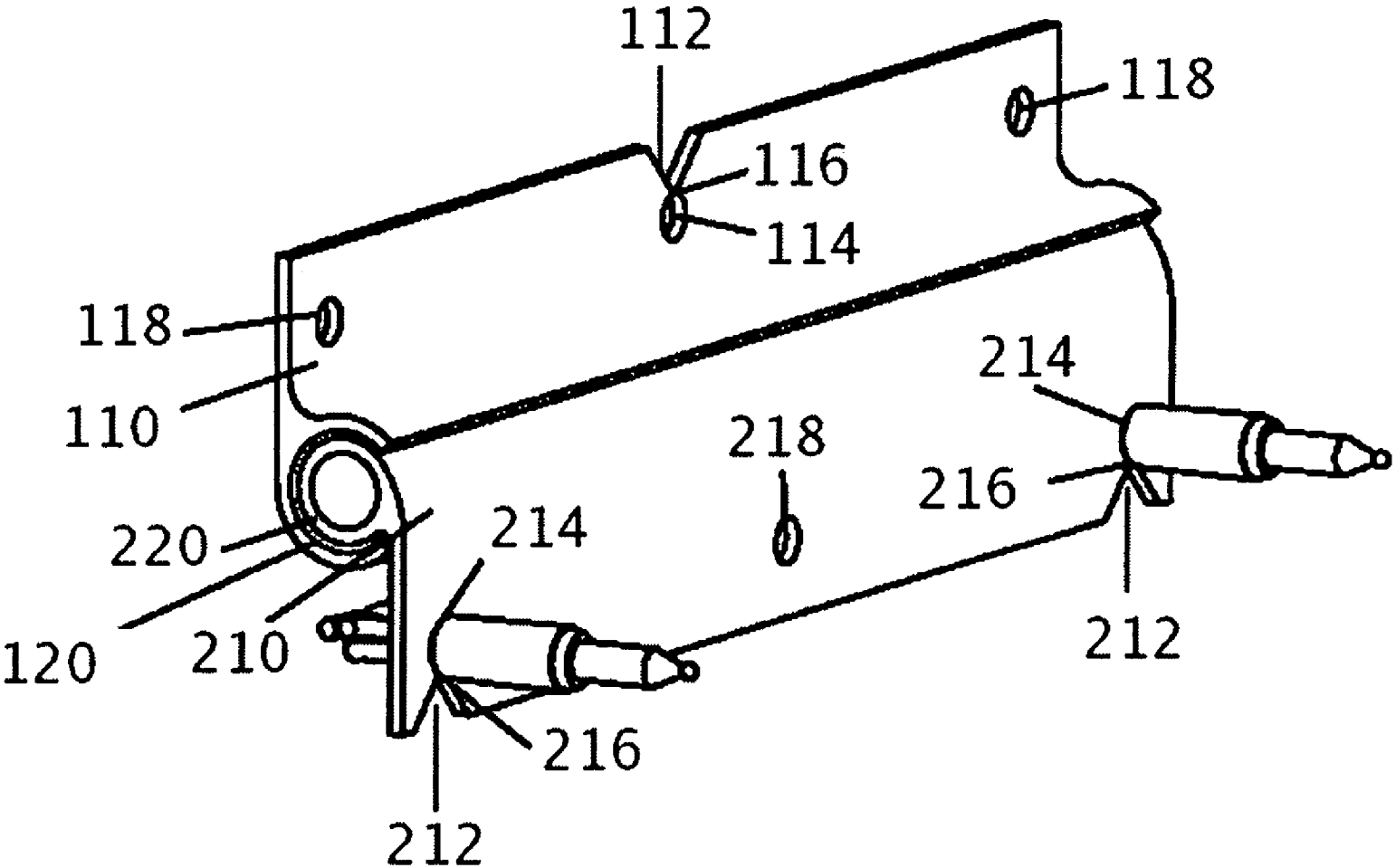
FIG. 12 is an isometric view of the coupled receiver and insert mount.

The manner of using the combined support for decorative lighting is to attach a receiver mount in FIG. 1 to the building or structure. Then attach the decorative lighting to an insert mount in FIG. 2. Next, align the receiver mount base 110 and the insert mount base 220 so that they are parallel and lead-in notches 112 and lead-in notches 212 are pointed in opposite directions. Finally, align and push the insert mount insert 220 into the receiver mount grip 120 so that the receiver mount grip 120 locks around the insert mount insert 220 as in FIGS. 3, 8, and 12.

The manner for removing an insert mount in FIG. 2 from a receiver mount in FIG. 1 is to grasp the insert mount base 210 and rotate around the longitudinal axis of the insert mount insert 220 while pulling away from the receiver mount grip 120, so that the back of the insert mount base 210 flexes the receiver mount grip 120 causing it to release the insert mount insert 220.

The manner of attaching the receiver mount shown in FIG. 1 to a building or structure is to use a fastener such as nails, screws, staples, etc. One holds the receiver mount base 110 against a surface of the building (or structure) so that gap 122 is pointed away from the surface of the building (or structure) and attaches the fasteners through the hole with grip 114 or the hole 118 into the building (or structure).

The manner of attaching decorative lighting to the insert support mount shown in FIG. 2 is identical to that for closures in present use. Namely, one holds the insert support base 210 so that the plane of its base is generally perpendicular to the axis of wires (or light base) and so that the lead-in notch 212 is adjacent to the wires (or light base). One inserts the wires (or light base) into the lead-in notch until it is forced past the gripping points 216 at the base of the notch and into hole 214.

To remove the decorative lighting from the insert support base 210, one first bends it along its vertical axis (FIG. 7—a sectional view) so that the insert support base is still in contact with the wires (or light base) of the decorative lighting and so that gripping points 216 roughly point in parallel directions. Then one pulls the insert support base 210 up or down and away from the from the wires in a direction generally opposite to that in which the gripping points now point, thus freeing the closure from the wires (or light base) without damaging the latter.

The insert mount in FIG. 2 can be used to attach decorative lighting many times.

Multiple insert mounts like the one shown in FIG. 2 can be used one at a time with the same receiver mount base in FIG. 1.

Insert mounts in FIG. 2 can be used for decorative light storage and stacked or placed in boxes with the decorative lighting still attached.

DETAILED DESCRIPTION—ALTERNATE EMBODIMENT—FIGS. 1, 2, 5, 7, AND 9

Figure 9:
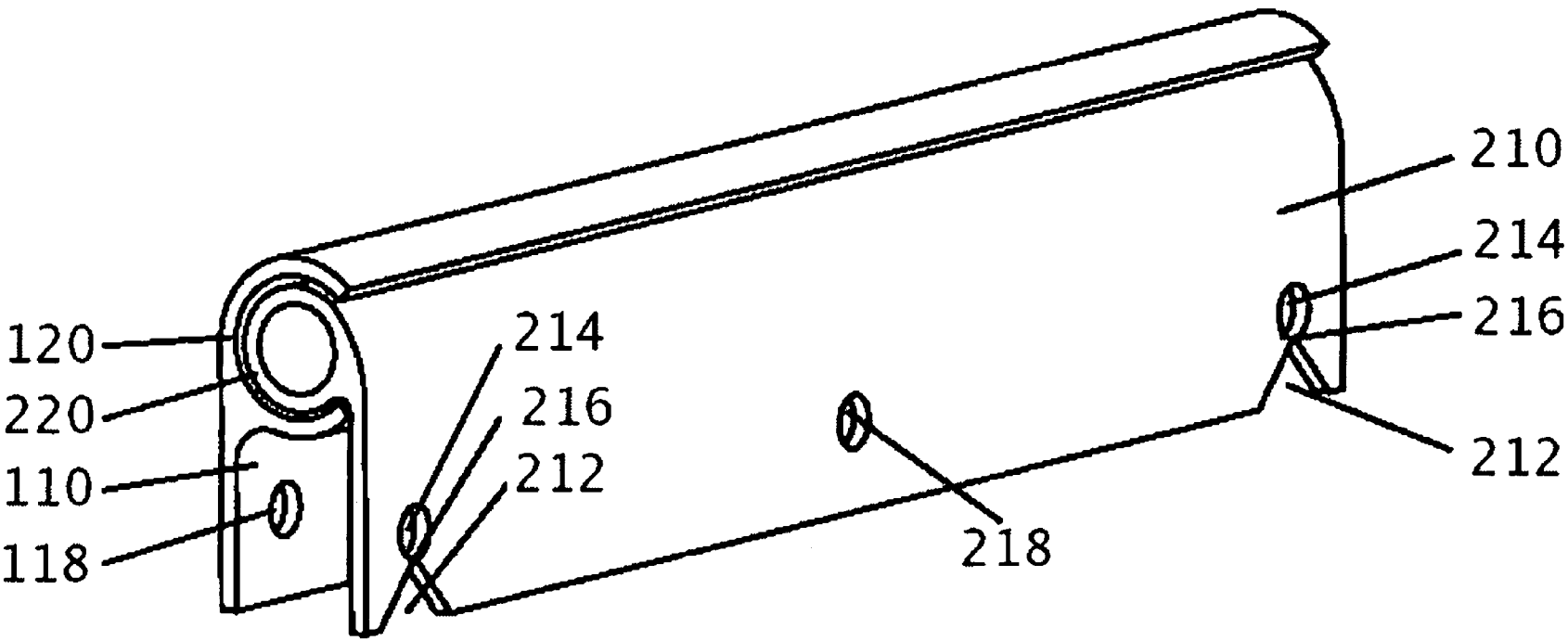
FIG. 9 is the coupled view of the downward-facing receiver and insert mount.

An alternate embodiment of a combined support is illustrated in FIG. 9 (isometric view). The combined support has a receiver mount base FIG. 1 of uniform cross section consisting of flexible material which can be repeatedly flexed without fracturing. The combined supports (receiver and insert mounts—FIGS. 1 and 2) are a flexible plastic that can be exposed to prolonged sunlight and outdoor weather conditions with minimal degradation. However, the combined supports can consist of any material that can be repeatedly bent without fracturing, such as polyethylene, polypropylene, vinyl, nylon, rubber, various impregnated or laminated fibrous materials, various plasticized materials, etc.

On one half of the receiver mount in FIG. 1 is the receiver base 110. Receiver base 110 has lead in notch 112 which terminates in gripping points 116 and leads to a hole with gripping point 114. Receiver base 110 can consist of many notches 112 with gripping points 116 and holes with gripping points 114 along its length. We presently contemplate that the receiver mount base 110 has attachment holes 118 at various points along its length to facilitate attaching the device to a structure. However, it can have notched holes (112, 116, and 114), attachment holes 118, or a combination of both of these. On the other half of the receiver mount in FIG. 1 is the receiver mount grip 120. Receiver mount grip 120 has a cross section shown in FIG. 5.

On one half of the insert mount in FIG. 2 is the insert base 210. Insert base 210 has lead in notch 212 which terminates in gripping points 216 and leads to a hole with gripping point 214. Insert base 210 can consist of many notches 212 with gripping points 216 and holes with gripping points 214 along its length. We presently contemplate that the insert mount base 210 has attachment holes 218 at various points along its length to facilitate attaching the device to a structure. However, it can have notched holes (212, 216, and 214), attachment holes 218, or a combination of both of these. On the other half of insert mount in FIG. 2 is the insert mount insert 220. Insert mount insert 220 has a cross section shown in FIG. 7.

A combined support is comprised of a receiver mount FIG. 1 (isometric view) and an insert mount FIG. 2 (isometric view). We presently contemplate that the receiver mount grip 120 in FIG. 1 and insert mount insert 220 in FIG. 2 would have a circular cross section (FIG. 5 and FIG. 7). However, it can have different cross sections, such as oval, triangular, circular, etc., and different sizes.

OPERATION—ALTERNATE EMBODIMENT—FIGS. 1, 2, 7, 9, 10, AND 11

Figure 10:
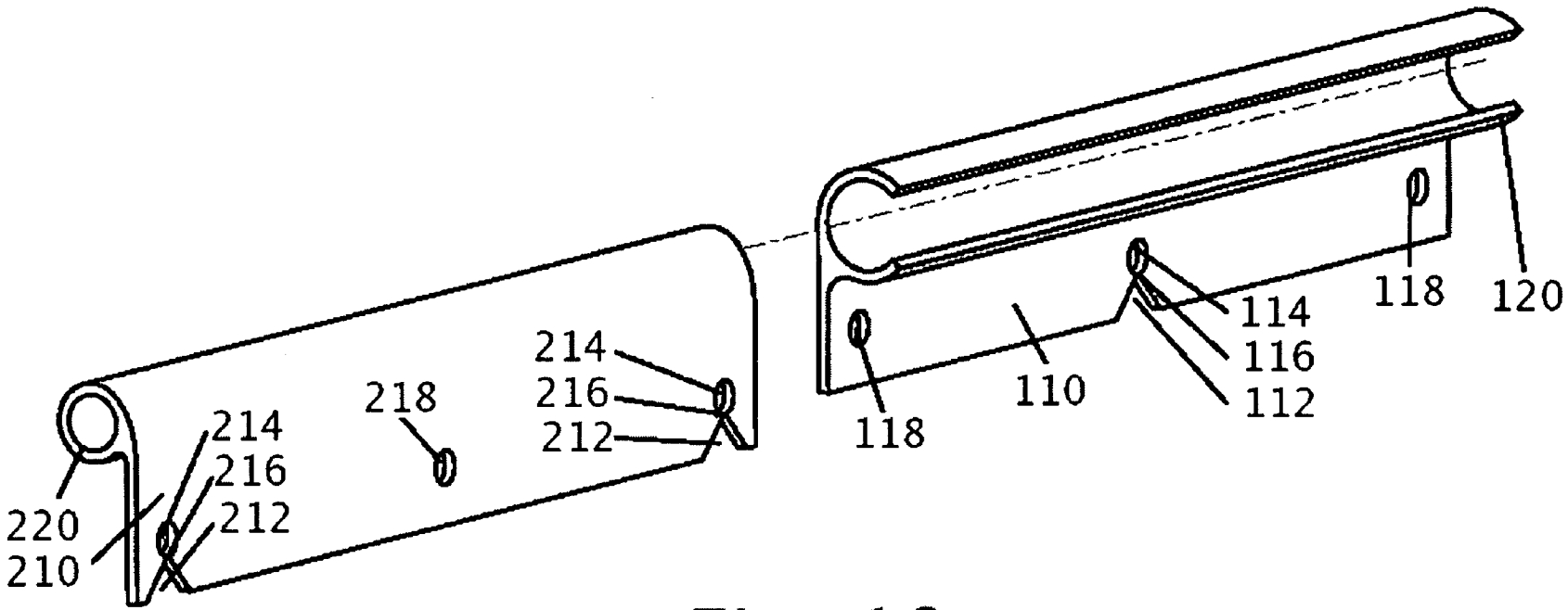
FIG. 10 is the exploded view of the downward-facing coupled receiver and insert mount.
Figure 11:
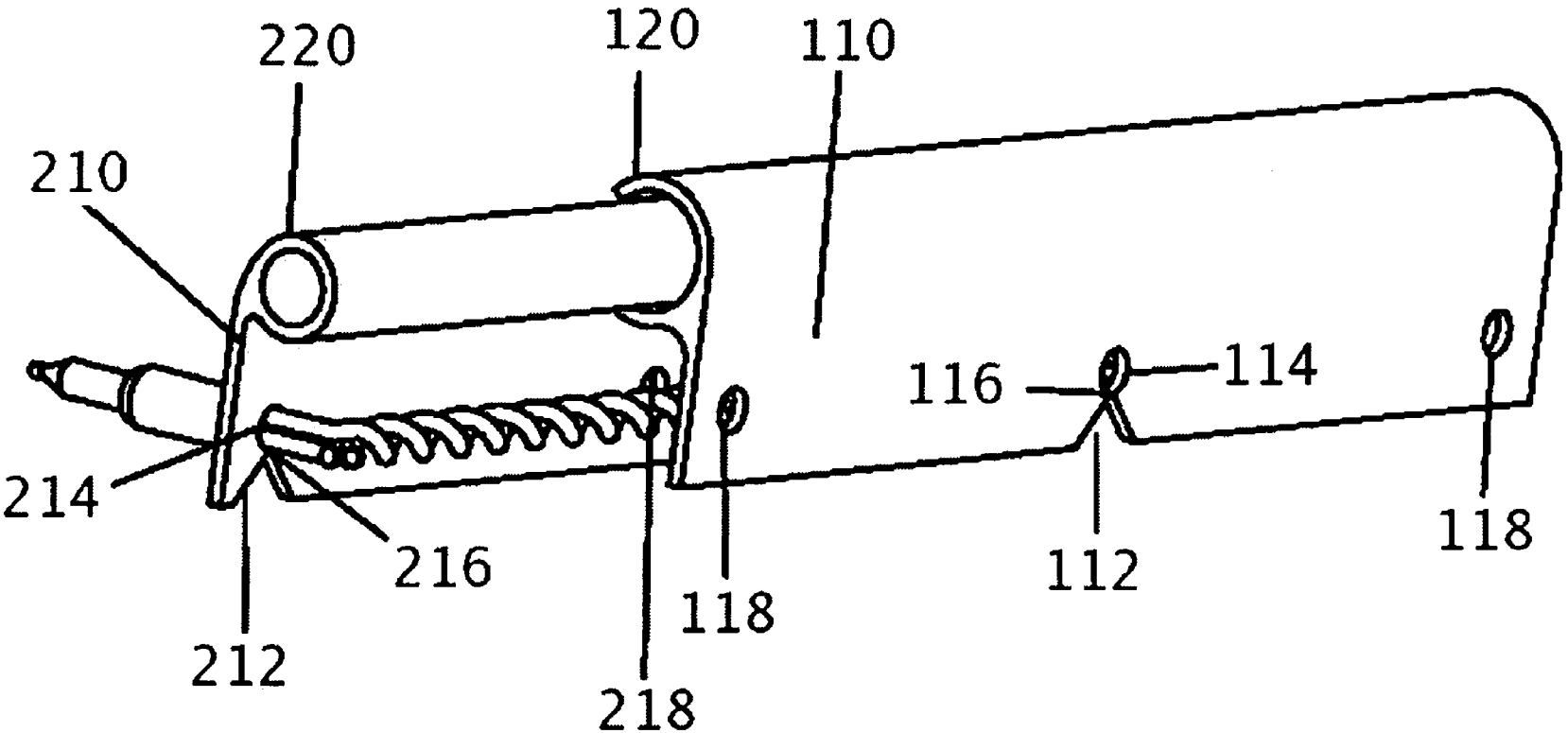
FIG. 11 is a cut-away view of the downward-facing coupled receiver and insert mount with lighting attached.

An alternate manner of using a combined support for decorative lighting is to attach a receiver mount in FIG. 1 to the building or structure. Then attach the decorative lighting to an insert mount in FIG. 2. Next, align the receiver mount base 110 and the insert mount base 220 so that they are parallel and lead-in notches 112 and lead-in notches 212 are pointed in the same direction. Finally, align and push the insert mount insert 220 into the receiver mount grip 120 so that the receiver mount grip 120 locks around the insert mount insert 220 as in FIGS. 9, 10, and 11.

The manner for removing an insert mount in FIG. 2 from a receiver mount in FIG. 1 is to grasp the insert mount base 210 and rotate around the longitudinal axis of the insert mount insert 220 while pulling away from the receiver mount grip 120, so that the back of the insert mount base 210 flexes the receiver mount grip 120 causing it to release the insert mount insert 220.

The manner of attaching the receiver mount shown in FIG. 1 to a building or structure is to use a fastener such as nails, screws, staples, etc. One holds the receiver mount base 110 against a surface of the building (or structure) so that gap 122 is pointed away from the surface of the building (or structure) and attaches the fasteners through the hole with grip 114 or the hole 118 into the building (or structure).

The manner of attaching decorative lighting to the insert support mount shown in FIG. 2 is identical to that for closures in present use. Namely, one holds the insert support base 210 so that the plane of its base is generally perpendicular to the axis of wires (or light base) and so that the lead-in notch 212 is adjacent to the wires (or light base). One inserts the wires (or light base) into the lead-in notch until it is forced past the gripping points 216 at the base of the notch and into hole 214.

To remove the decorative lighting from the insert support base 210, one first bends it along its vertical axis (FIG. 7—a sectional view) so that the insert support base is still in contact with the wires (or light base) of the decorative lighting and so that gripping points 216 roughly point in parallel directions. Then one pulls the insert support base 210 up or down and away from the from the wires in a direction generally opposite to that in which the gripping points now point, thus freeing the closure from the wires (or light base) without damaging the latter.

The insert mount in FIG. 2 can be used to attach decorative lighting many times.

Multiple insert mounts like the one shown in FIG. 2 can be used one at a time with the same receiver mount base in FIG. 1.

Insert mounts in FIG. 2 can be used for decorative light storage and stacked or placed in boxes with the decorative lighting still attached.

DETAILED DESCRIPTION—ALTERNATE EMBODIMENT—FIGS. 1, 2, 5, 7, AND 9

An alternate embodiment of a combined support is illustrated in FIG. 9 (isometric view). The combined support has a receiver mount base FIG. 1 of uniform cross section consisting of flexible material which can be repeatedly flexed without fracturing. The combined supports (receiver and insert mounts—FIGS. 1 and 2) are a flexible plastic that can be exposed to prolonged sunlight and outdoor weather conditions with minimal degradation. However, the combined supports can consist of any material that can be repeatedly bent without fracturing, such as polyethylene, polypropylene, vinyl, nylon, rubber, various impregnated or laminated fibrous materials, various plasticized materials, etc.

On one half of the receiver mount in FIG. 1 is the receiver base 110. Receiver base 110 has lead in notch 112 which terminates in gripping points 116 and leads to a hole with gripping point 114. Receiver base 110 can consist of many notches 112 with gripping points 116 and holes with gripping points 114 along its length. We presently contemplate that the receiver mount base 110 has attachment holes 118 at various points along its length to facilitate attaching the device to a structure. However, it can have notched holes (112, 116, and 114), attachment holes 118, or a combination of both of these. On the other half of the receiver mount in FIG. 1 is the receiver mount grip 120. Receiver mount grip 120 has a cross section shown in FIG. 5.

On one half of the insert mount in FIG. 2 is the insert base 210. Insert base 210 has lead in notch 212 which terminates in gripping points 216 and leads to a hole with gripping point 214. Insert base 210 can consist of many notches 212 with gripping points 216 and holes with gripping points 214 along its length. We presently contemplate that the insert mount base 210 has attachment holes 218 at various points along its length to facilitate attaching the device to a structure. However, it can have notched holes (212, 216, and 214), attachment holes 218, or a combination of both of these. On the other half of insert mount in FIG. 2 is the insert mount insert 220. Insert mount insert 220 has a cross section shown in FIG. 7.

The combined support is comprised of a receiver mount FIG. 1 (isometric view) and an insert mount FIG. 2 (isometric view). We presently contemplate that the receiver mount grip 120 in FIG. 1 and insert mount insert 220 in FIG. 2 would have a circular cross section (FIG. 5 and FIG. 7). However, it can have different cross sections, such as oval, triangular, circular, etc., and different sizes.

OPERATION—ALTERNATE EMBODIMENT—FIGS. 1, 2, 7, 9, 10, AND 11

An alternate manner of using a combined support for decorative lighting is to attach the decorative lighting to an insert mount in FIG. 2. Next, align a receiver mount base 110 and the insert mount base 220 so that they are parallel and lead-in notches 112 and lead-in notches 212 are pointed in the same direction. Next, align and push the insert mount insert 220 into the receiver mount grip 120 so that the receiver mount grip 120 locks around the insert mount insert 220 as in FIGS. 9, 10, and 11. The coupled face-to-face configuration can then be placed in a yard or along horizontal surfaces to form patterns or boundaries, such as lining a driveway or sidewalk.

The manner for removing an insert mount in FIG. 2 from a receiver mount in FIG. 1 is to grasp the insert mount base 210 and rotate around the longitudinal axis of the insert mount insert 220 while pulling away from the receiver mount grip 120, so that the back of the insert mount base 210 flexes the receiver mount grip 120 causing it to release the insert mount insert 220.

The manner of placing a coupled face-to-face configuration shown in FIG. 9 in a yard or along a horizontal surface is to use gravity, stakes, or weights. One inserts a stake into the ground and then fastens the coupled system to the stake so that the decorative lighting is facing in the desired direction.

The manner of attaching decorative lighting to the insert support mount shown in FIG. 2 is identical to that for closures in present use. Namely, one holds the insert support base 210 so that the plane of its base is generally perpendicular to the axis of wires (or light base) and so that the lead-in notch 212 is adjacent to the wires (or light base). One inserts the wires (or light base) into the lead-in notch until it is forced past the gripping points 216 at the base of the notch and into hole 214.

To remove the decorative lighting from the insert support base 210, one first bends it along its vertical axis (FIG. 7—a sectional view) so that the insert support base is still in contact with the wires (or light base) of the decorative lighting and so that gripping points 216 roughly point in parallel directions. Then one pulls the insert support base 210 up or down and away from the from the wires in a direction generally opposite to that in which the gripping points now point, thus freeing the closure from the wires (or light base) without damaging the latter.

A coupled structure as in FIG. 3 can be used to attach decorative lighting many times.

Multiple insert mounts like the one shown in FIG. 2 can be used one at a time with the same receiver mount base in FIG. 1.

A coupled structure as in FIG. 3 can be used for decorative light storage and stacked or placed in boxes with the decorative lighting still attached.

DETAILED DESCRIPTION—ALTERNATE EMBODIMENT—FIGS. 1, 2, 3, 5, AND 7

Another embodiment of a combined support is illustrated in FIG. 3 (isometric view). The combined support has a receiver mount base FIG. 1 of uniform cross section consisting of flexible material which can be repeatedly flexed without fracturing. The combined supports (receiver and insert mounts—FIGS. 1 and 2) are a flexible plastic that can be exposed to prolonged sunlight and outdoor weather conditions with minimal degradation. However, the combined supports can consist of any material that can be repeatedly bent without fracturing, such as polyethylene, polypropylene, vinyl, nylon, rubber, various impregnated or laminated fibrous materials, various plasticized materials, etc.

On one half of the receiver mount in FIG. 1 is the receiver base 110. Receiver base 110 has lead in notch 112 which terminates in gripping points 116 and leads to a hole with gripping point 114. Receiver base 110 can consist of many notches 112 with gripping points 116 and holes with gripping points 114 along its length. We presently contemplate that the receiver mount base 110 has attachment holes 118 at various points along its length to facilitate attaching the device to a structure. However, it can have notched holes (112, 116, and 114), attachment holes 118, or a combination of both of these. On the other half of the receiver mount in FIG. 1 is the receiver mount grip 120. Receiver mount grip 120 has a cross section shown in FIG. 5.

On one half of the insert mount in FIG. 2 is the insert base 210. Insert base 210 has lead in notch 212 which terminates in gripping points 216 and leads to a hole with gripping point 214. Insert base 210 can consist of many notches 212 with gripping points 216 and holes with gripping points 214 along its length. We presently contemplate that the insert mount base 210 has attachment holes 218 at various points along its length to facilitate attaching the device to a structure. However, it can have notched holes (212, 216, and 214), attachment holes 218, or a combination of both of these. On the other half of insert mount in FIG. 2 is the insert mount insert 220. Insert mount insert 220 has a cross section shown in FIG. 7.

The combined support is comprised of a receiver mount FIG. 1 (isometric view) and an insert mount FIG. 2 (isometric view). We presently contemplate that the receiver mount grip 120 in FIG. 1 and insert mount insert 220 in FIG. 2 would have a circular cross section (FIG. 5 and FIG. 7). However, it can have different cross sections, such as oval, triangular, circular, etc., and different sizes.

OPERATION—ALTERNATE EMBODIMENT—FIGS. 1, 2, 3, 5, 8, AND 12

The manner of using a combined support for decorative lighting is to attach an insert mount in FIG. 2 to the building or structure. Then attach the decorative lighting to a receiver mount in FIG. 1. Next, align the receiver mount base 110 and the insert mount base 220 so that they are parallel and lead-in notches 112 and lead-in notches 212 are pointed in opposite directions. Finally, align and push the receiver mount grip 120 over the insert mount insert 220 so that the receiver mount grip 120 locks around the insert mount insert 220 as in FIGS. 3, 8, and 12.

The manner for removing a receiver mount in FIG. 1 from an insert mount in FIG. 2 is to grasp the receiver mount base 110 and rotate around the longitudinal axis of the receiver mount grip 120 while pulling away from the insert mount insert 220, so that the back of the receiver mount base 110 flexes the receiver mount grip 120 causing it to release the insert mount insert 220.

The manner of attaching the receiver mount shown in FIG. 2 to a building or structure is to use a fastener such as nails, screws, staples, etc. One holds the insert mount base 210 against a surface of the building (or structure) so that insert mount insert 220 is pointed away from the surface of the building (or structure) and attaches the fasteners through the hole with grip 214 or the hole 218 into the building (or structure).

The manner of attaching decorative lighting to the receiver support mount shown in FIG. 1 is identical to that for closures in present use. Namely, one holds the receiver mount base 110 so that the plane of its base is generally perpendicular to the axis of wires (or light base) and so that the lead-in notch 112 is adjacent to the wires (or light base). One inserts the wires (or light base) into the lead-in notch until it is forced past the gripping points 116 at the base of the notch and into hole 114.

To remove the decorative lighting from the receiver mount base 110, one first bends it along its vertical axis (FIG. 5—a sectional view) so that the insert support base is still in contact with the wires (or light base) of the decorative lighting and so that gripping points 116 roughly point in parallel directions. Then one pulls the receiver mount base 110 up or down and away from the from the wires in a direction generally opposite to that in which the gripping points now point, thus freeing the closure from the wires (or light base) without damaging the latter.

The receiver mount in FIG. 1 can be used to attach decorative lighting many times.

Multiple receiver mounts like the one shown in FIG. 1 can be used one at a time with the same insert mount base in FIG. 2.

Receiver mount in FIG. 1 can be used for decorative light storage and stacked or placed in boxes with the decorative lighting still attached.

DETAILED DESCRIPTION—ALTERNATE EMBODIMENT—FIGS. 1, 2, 5, 7, AND 9

An alternate embodiment of a combined support is illustrated in FIG. 9 (isometric view). The combined support has a receiver mount base FIG. 1 of uniform cross section consisting of flexible material which can be repeatedly flexed without fracturing. The combined supports (receiver and insert mounts—FIGS. 1 and 2) are a flexible plastic that can be exposed to prolonged sunlight and outdoor weather conditions with minimal degradation. However, the combined supports can consist of any material that can be repeatedly bent without fracturing, such as polyethylene, polypropylene, vinyl, nylon, rubber, various impregnated or laminated fibrous materials, various plasticized materials, etc.

On one half of the receiver mount in FIG. 1 is the receiver base 110. Receiver base 110 has lead in notch 112 which terminates in gripping points 116 and leads to a hole with gripping point 114. Receiver base 110 can consist of many notches 112 with gripping points 116 and holes with gripping points 114 along its length. We presently contemplate that the receiver mount base 110 has attachment holes 118 at various points along its length to facilitate attaching the device to a structure. However, it can have notched holes (112, 116, and 114), attachment holes 118, or a combination of both of these. On the other half of the receiver mount in FIG. 1 is the receiver mount grip 120. Receiver mount grip 120 has a cross section shown in FIG. 5.

On one half of the insert mount in FIG. 2 is the insert base 210. Insert base 210 has lead in notch 212 which terminates in gripping points 216 and leads to a hole with gripping point 214. Insert base 210 can consist of many notches 212 with gripping points 216 and holes with gripping points 214 along its length. We presently contemplate that the insert mount base 210 has attachment holes 218 at various points along its length to facilitate attaching the device to a structure. However, it can have notched holes (212, 216, and 214), attachment holes 218, or a combination of both of these. On the other half of insert mount in FIG. 2 is the insert mount insert 220. Insert mount insert 220 has a cross section shown in FIG. 7.

The combined support is comprised of a receiver mount FIG. 1 (isometric view) and an insert mount FIG. 2 (isometric view). We presently contemplate that the receiver mount grip 120 in FIG. 1 and insert mount insert 220 in FIG. 2 would have a circular cross section (FIG. 5 and FIG. 7). However, it can have different cross sections, such as oval, triangular, circular, etc., and different sizes.

OPERATION—ALTERNATE EMBODIMENT—FIGS. 1, 2, 5, 9, AND 10

An alternate manner of using a combined support for decorative lighting is to attach an insert mount in FIG. 2 to the building or structure. Then attach the decorative lighting to a receiver mount in FIG. 1. Next, align the receiver mount base 110 and the insert mount base 220 so that they are parallel and lead-in notches 112 and lead-in notches 212 are pointed in the same direction. Finally, align and push the receiver mount grip 120 over the insert mount insert 220 so that the receiver mount grip 120 locks around the insert mount insert 220 as in FIG. 9.

The manner for removing a receiver mount in FIG. 1 from an insert mount in FIG. 2 is to grasp the receiver mount base 110 and rotate around the longitudinal axis of the receiver mount grip 120 while pulling away from the insert mount insert 220, so that the back of the receiver mount base 110 flexes the receiver mount grip 120 causing it to release the insert mount insert 220.

The manner of attaching the insert mount shown in FIG. 2 to a building or structure is to use a fastener such as nails, screws, staples, etc. One holds the insert mount base 210 against a surface of the building (or structure) so that the insert mount insert 220 is pointed away from the surface of the building (or structure) and attaches the fasteners through the hole with grip 214 or the hole 218 into the building (or structure).

The manner of attaching decorative lighting to the receiver mount support shown in FIG. 1 is identical to that for closures in present use. Namely, one holds the receiver support base 110 so that the plane of its base is generally perpendicular to the axis of wires (or light base) and so that the lead-in notch 112 is adjacent to the wires (or light base). One inserts the wires (or light base) into the lead-in notch until it is forced past the gripping points 116 at the base of the notch and into hole 114.

To remove the decorative lighting from the receiver support base 110, one first bends it along its vertical axis (FIG. 5—a sectional view) so that the insert support base is still in contact with the wires (or light base) of the decorative lighting and so that gripping points 116 roughly point in parallel directions. Then one pulls the insert support base 110 up or down and away from the from the wires in a direction generally opposite to that in which the gripping points now point, thus freeing the closure from the wires (or light base) without damaging the latter.

The receiver mount in FIG. 1 can be used to attach decorative lighting many times.

Multiple receiver mounts like the one shown in FIG. 1 can be used one at a time with the same insert mount base in FIG. 2.

Receiver mounts in FIG. 1 can be used for decorative light storage and stacked or placed in boxes with the decorative lighting still attached.

CONCLUSION, RAMIFICATIONS, AND SCOPE

Thus the reader will see that at least one embodiment of the Pliable Combined Support For Decorative Lighting provides shear, tensile, compression and tension support to decorative lighting as well as easy attachment of decorative lighting to a structure or building.

While the above description contains many specificities, these should not be construed as limitations on the scope of any embodiment, but as exemplifications of the presently preferred embodiments thereof. Many other ramifications and variations are possible within the teachings of the various embodiments. For example, cutting a receiver and mounting support into short segments and arranging in patterns such as a zig-zag to further augment the lighting, or mounting in vertical patterns along a structure.

Thus, the scope of the invention should be determined by the appended claims and their legal equivalents, and not by the examples given.

The invention claimed is:

1. A light mounting and storage bracket assembly comprising:

a. An elongated channel with a tangential extrusion with holes for impermanent mounting to a surface or structure and gripping points for receiving lights;

b. An elongated insert with a tangential extrusion with holes for impermanent mounting to a surface or structure and gripping points for receiving lights; and, c. Said elongated inserts are removably received in the channel for a rotational frictional attachment whereby the lighting is displayed in a fixed position along the surface.

* * * * *